United States Patent [19]

Micheletti

[11] 4,346,571

[45] Aug. 31, 1982

[54] CIRCULAR KNITTING MACHINES

[76] Inventor: Arrigo Micheletti, 3, Viale Papa Giovanni XXIII°, Fucecchio, Firenze, Italy

[21] Appl. No.: 165,697

[22] Filed: Jul. 3, 1980

[30] Foreign Application Priority Data

Jul. 9, 1979 [IT] Italy ..... 9480 A/79

[51] Int. Cl.[3] ..... D04B 15/32; D04B 15/00

[52] U.S. Cl. ..... 66/55; 66/237

[58] Field of Search ..... 66/55, 231, 236, 237

[56] References Cited

U.S. PATENT DOCUMENTS

| | | | |
|---|---|---|---|
| 726,178 | 4/1903 | Mayo | 66/237 X |
| 1,172,090 | 2/1916 | Wildman et al. | 66/237 |
| 2,143,198 | 1/1939 | Lawson et al. | 66/237 X |
| 2,749,728 | 6/1956 | Griesbach | 66/231 X |
| 4,151,729 | 5/1979 | Micheletti | 66/231 X |
| 4,267,708 | 5/1981 | Chietti | 66/237 X |

FOREIGN PATENT DOCUMENTS

| | | | |
|---|---|---|---|
| 1032874 | 6/1958 | Fed. Rep. of Germany | 66/55 |
| 2303253 | 8/1973 | Fed. Rep. of Germany | 66/236 |
| 1357316 | 2/1964 | France | 66/55 |
| 2010342 | 6/1979 | United Kingdom | 66/237 |
| 390216 | 11/1973 | U.S.S.R. | 66/231 |

*Primary Examiner*—Wm. Carter Reynolds
*Attorney, Agent, or Firm*—McGlew and Tuttle

[57] ABSTRACT

In a circular knitting machine, a cam drum which controls control members co-operating with the needle cylinder is disposed coaxially with the cylinder. A program drum which advances as a function of the rotation of the needle cylinder is also coaxial with the needle cylinder. A rapid control mechanism acts on a ratchet toothed ring gear of the program drum to change the programmed cycle phases and to move it to a zero position, that is a cycle commencement position. A control device acts on a ring gear for the advancement of the cam drum and is activated when the program drum attains the zero position in order to also move the cam drum into the zero position.

3 Claims, 20 Drawing Figures

VI
138
134
128A
128
122
VII
VII
136
120
140
52
52A
VIII
156
150
154
VIII
50
152
200
148
26
152A
4
130
132
V
7
56
48
VI
60
170-158
7
62
72
100
V
160-168
70
162 A
68

Fig. 15
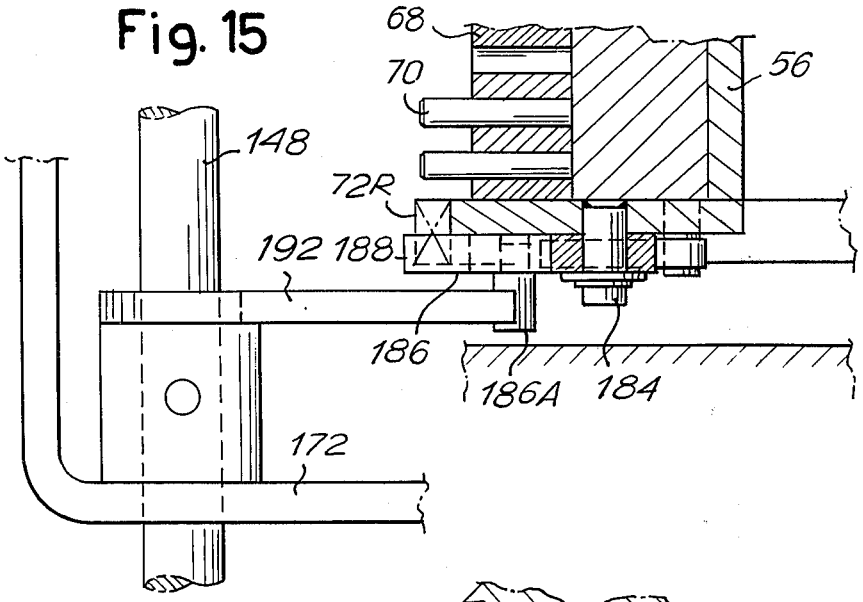
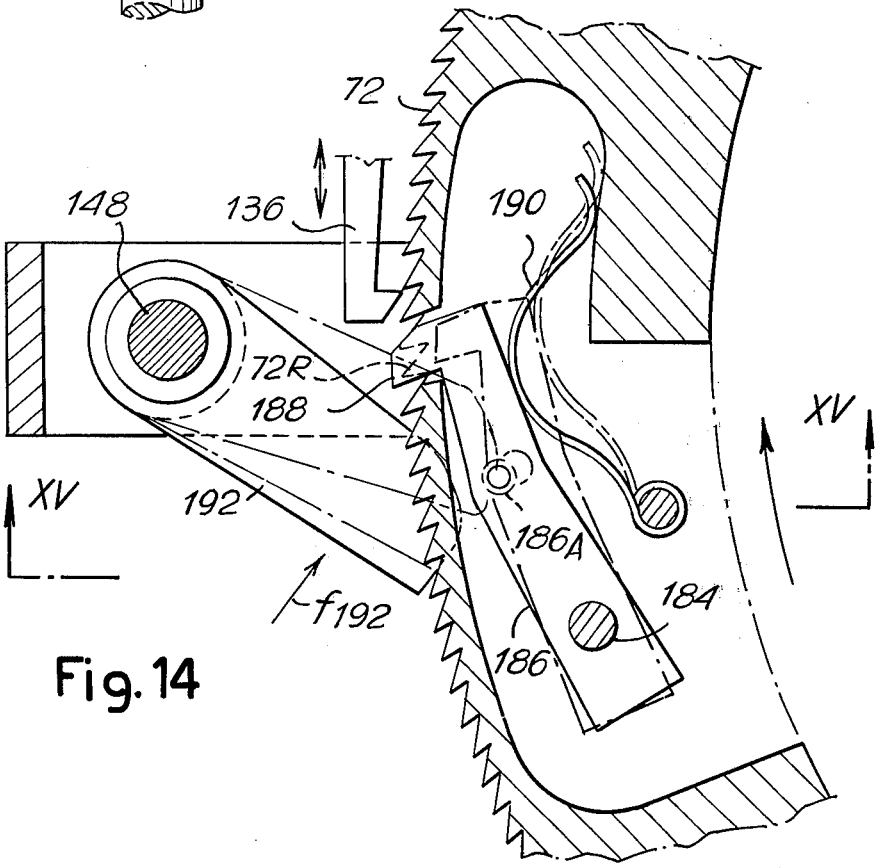
Fig. 14

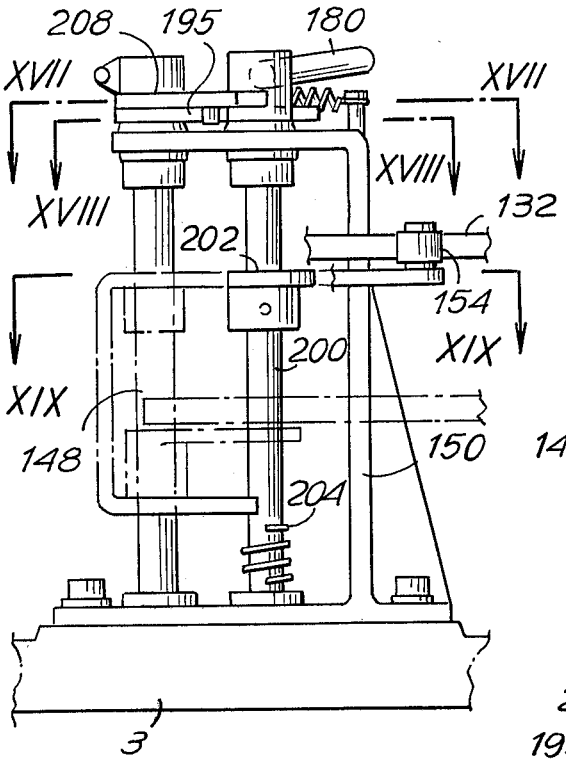
Fig. 16
Fig. 17
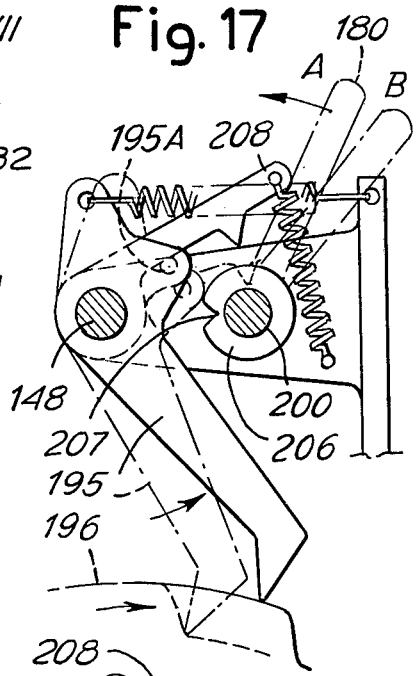
Fig. 18
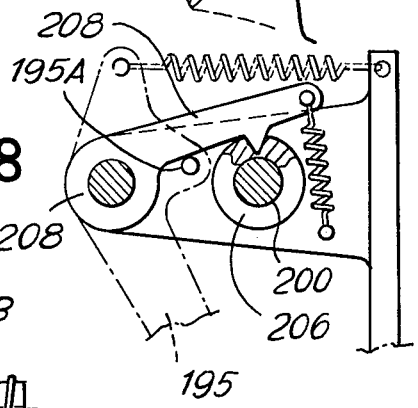
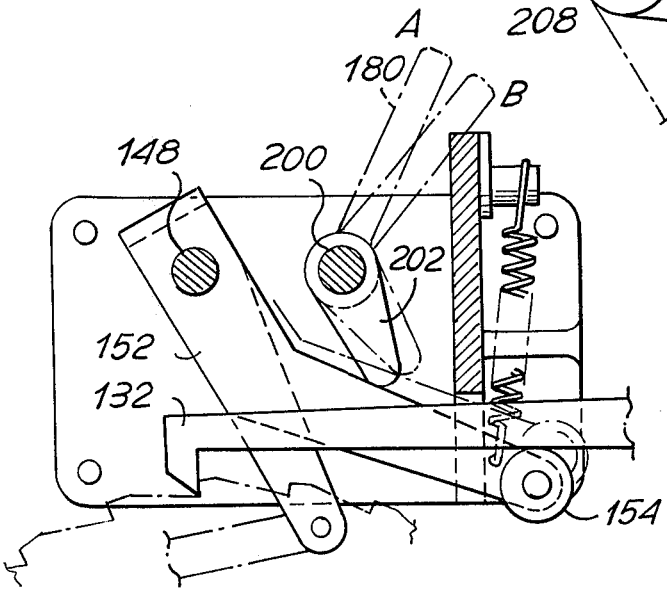
FIG. 19

CIRCULAR KNITTING MACHINES

FIELD OF THE INVENTION

The present invention relates to circular knitting machines, and more particularly to circular knitting machines for knitting stockings.

SUMMARY OF THE INVENTION

According to the invention there is provided in a circular knitting machine, a needle cylinder, a cam drum coaxial with the needle cylinder, and programming means which advances as a function of the rotation of the needle cylinder, said programming means comprising a program drum coaxial with the needle cylinder, rapid programming control means operative to change a programmed cycle phase and to move the program drum to a cycle commencement position, where it stops, and means for controlling the advancement of the cam drum, said control means being activated when the program drum attains said cycle commencement position in order to also move said cam drum into its zero position, to enable them to again start in phase for a new cycle.

In a practical embodiment there is provided a circular machine comprising a needle cylinder with needles and jacks, a plurality of control members for these latter and for the yarn guides, a cam drum coaxial with the needle cylinder and driven by a ratchet system, programming means, and means for advancing said programmer in relation to the rotation of the cylinder. In this embodiment: the programming means is in the form of a drum coaxial with the cylinder and with the cam drum but independent thereof, and is made to advance with slow motion by a drive system synchronised with the motion of the cylinder, and is provided with pins, rollers or other profiles which can easily be changed; a ratchet system determines the length of the programs and the re-phasing, and is arranged for the rapid advancement of the program drum, this system being able to be combined with the ratchet drive system of the cam drum; follower means with their axes parallel to the cylinder axis act—either directly or by way of transmission systems—in order to activate and deactivate the ratchet systems by inserting pins or rollers, and a manual control can activate the rapid advancement re-phasing system for the program drum until this latter reaches a "zero" position in which a covered tooth prevents the rapid advancement of said program drum from continuing; a pin or roller disposed in the zero position of the program drum activates the cam drum pawl until the cam drum is also moved into the zero position; and a cam in the "zero" position on the cam drum controls the initial slow advancement of the program drum when both the drums reach an in-phase zero position.

A slow advancement ring gear can be provided on the program drum to co-operate with a corresponding slow motion pawl, the ring gear comprising at a stop and zero point at least one tooth which can be covered by a higher movable profile. This profile is arranged to project from the teeth to neutralise the slow advancement pawl, and is carried by a lever which is moved by a rod system or other linkage in order to remove the profile, the rod system being made to remove the profile by the cam in the zero position of the cam drum.

A gradual cam for contracting the stitch in the ankle position can be provided on the program drum to advance continuously with the rotation of the cylinder, other contraction and expansion cams being provided in the cam drum, a single follower lever with a respective rod system being provided for controlling the cylinder axially, it being moved by individual followers which can be individually screw-adjusted.

BRIEF DESCRIPTION OF THE DRAWINGS

An embodiment of the invention will now be described by way of example only, with reference to the accompanying diagrammatic drawings, in which:

FIGS. 14 and 15 show a detail in sectional view on the line XIV—XIV of FIG. 5 and in section view on the line XV—XV of FIG. 14; and FIGS. 16 to 19 show details of the manual control arrangement in a section analogous to that of FIG. 6, and in horizontal sections on the line XVII—XVII, XVIII—XVIII and XIX—XIX of FIG. 16.

BRIEF DESCRIPTION OF THE PREFERRED EMBODIMENT

Figure 1:
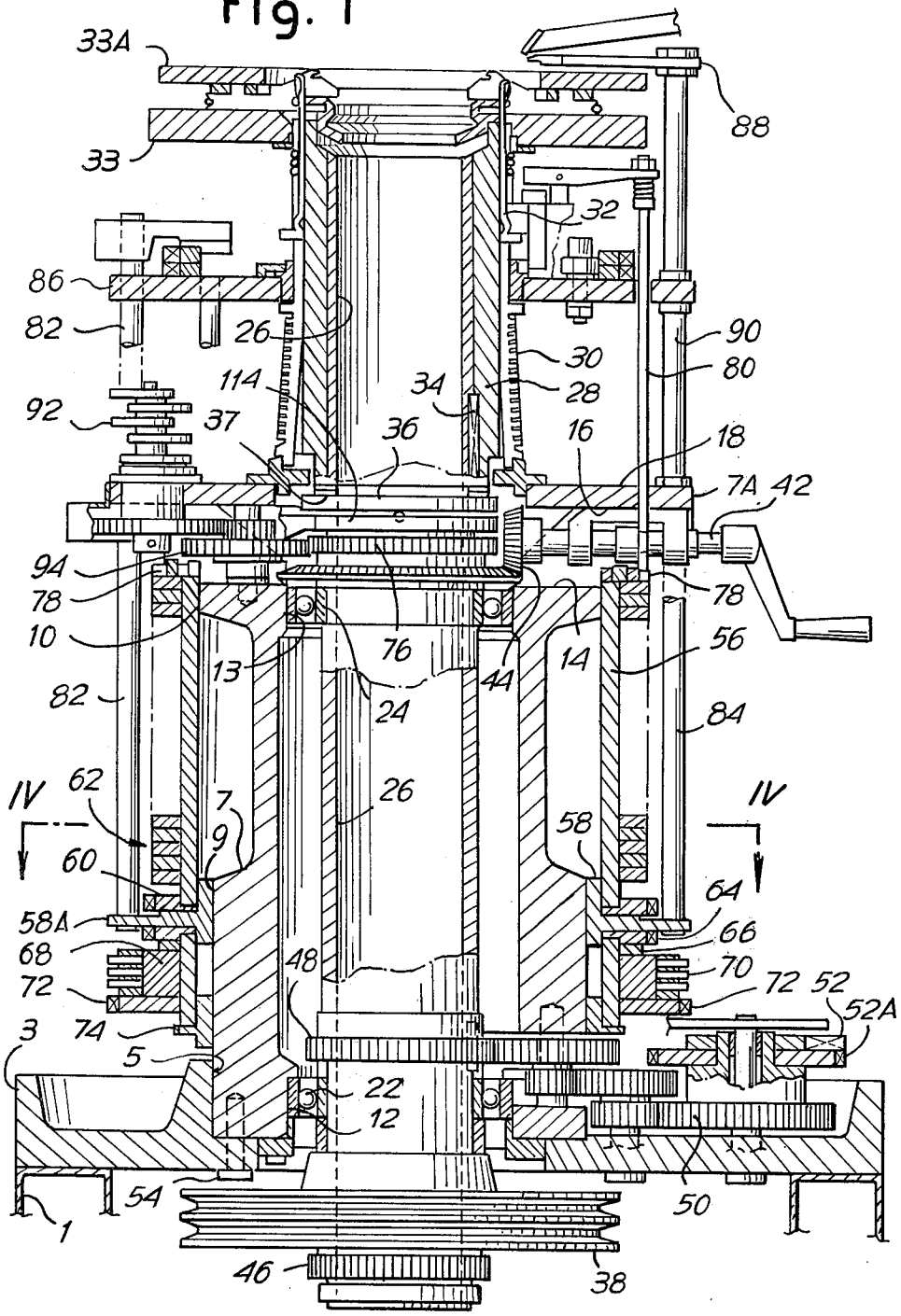
FIG. 1 is an overall section through a circular knitting machine on a plane passing through the axis of the needle cylinder.
Figure 2:
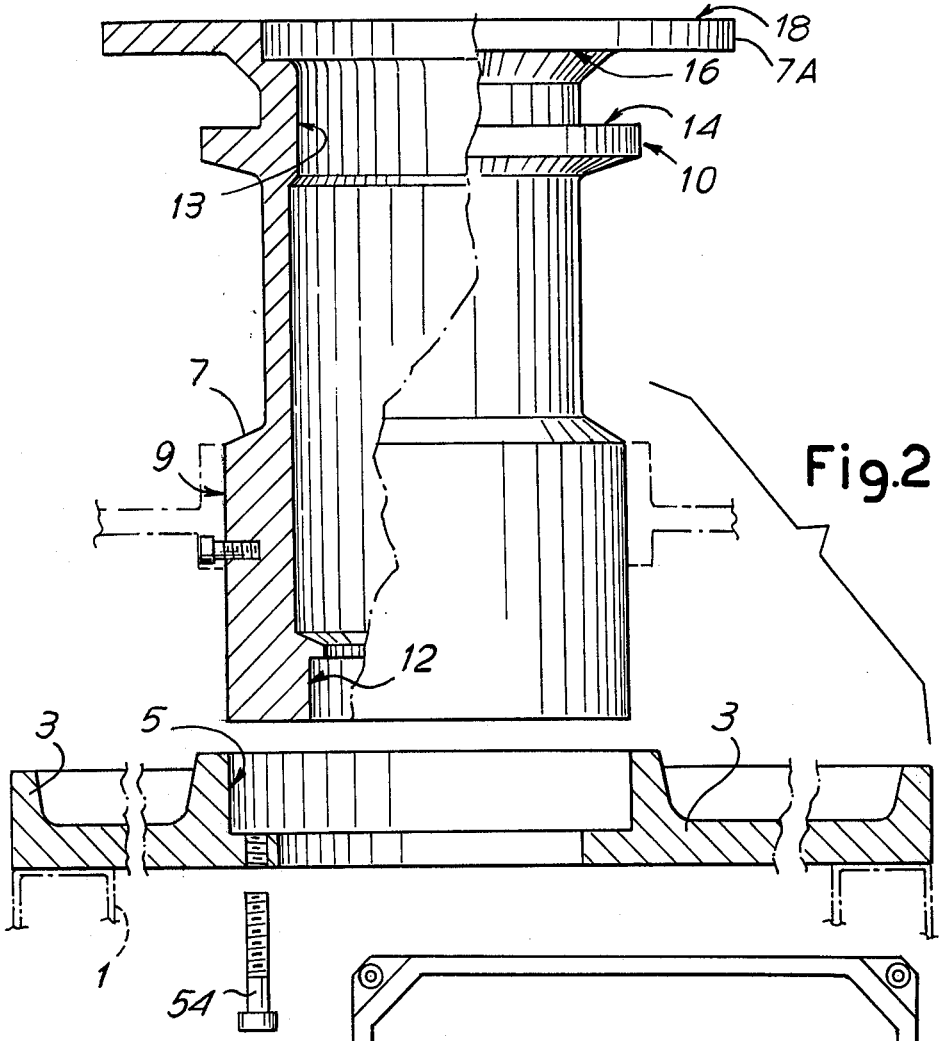
FIGS. 2 and 3 are respectively an axial section through a lathe-turned block which forms the frame, and a plan view of a base plate for this latter.
Figure 3:
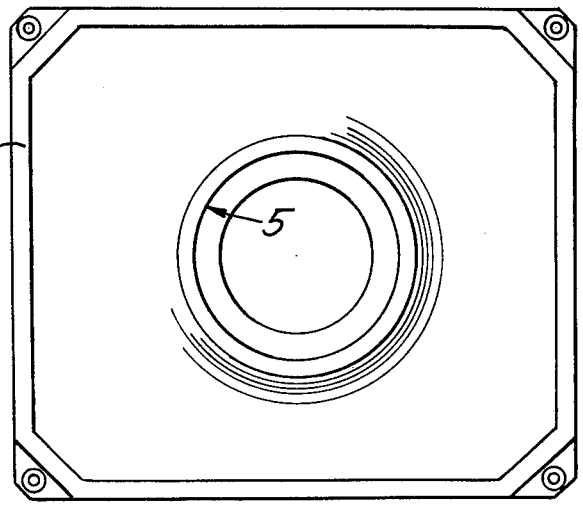
Figure 4:
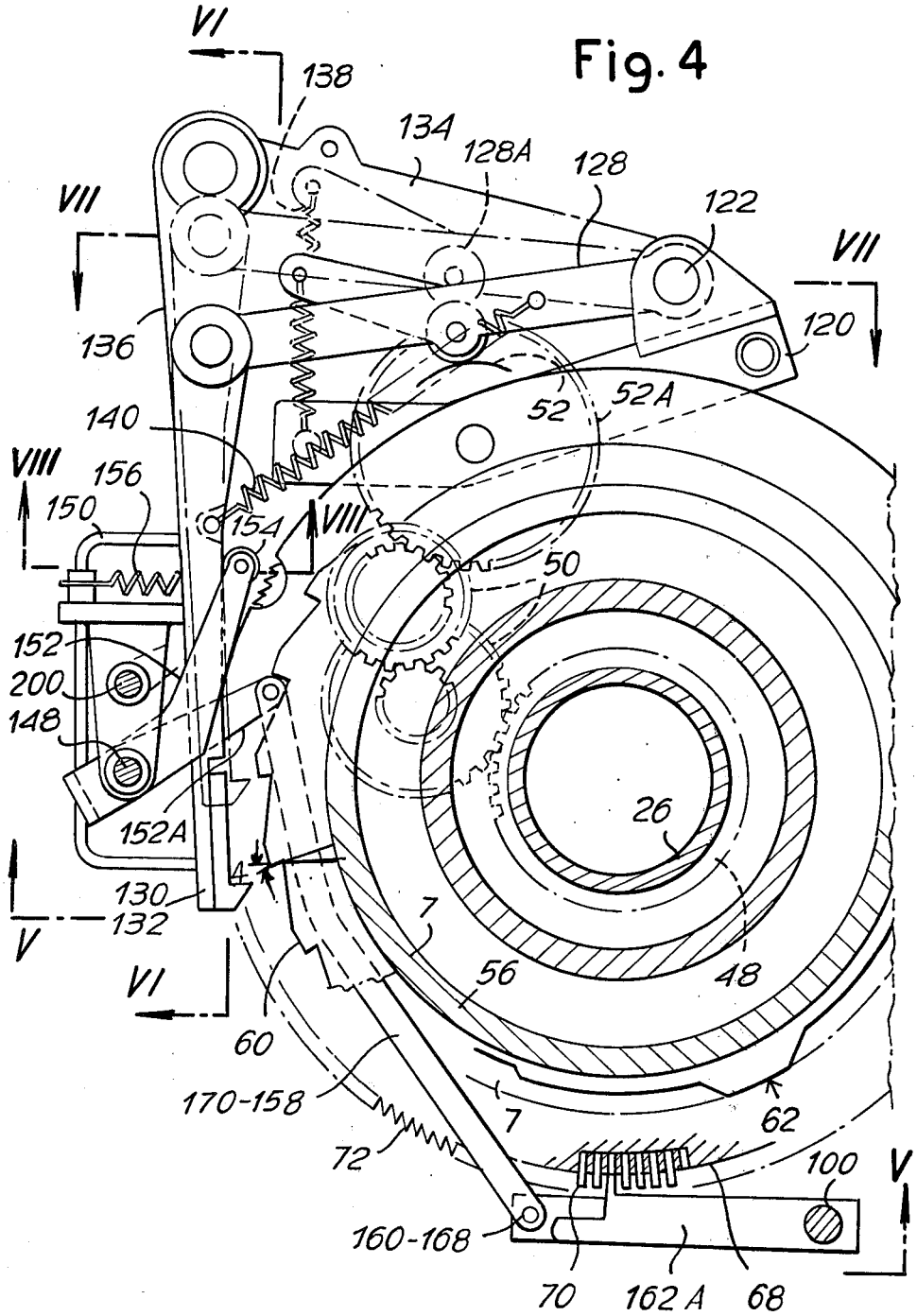
FIGS. 4 and 4A show a section on the line IV—IV of FIG. 1, with the members illustrated therein in two different positions.
Figure 4A:
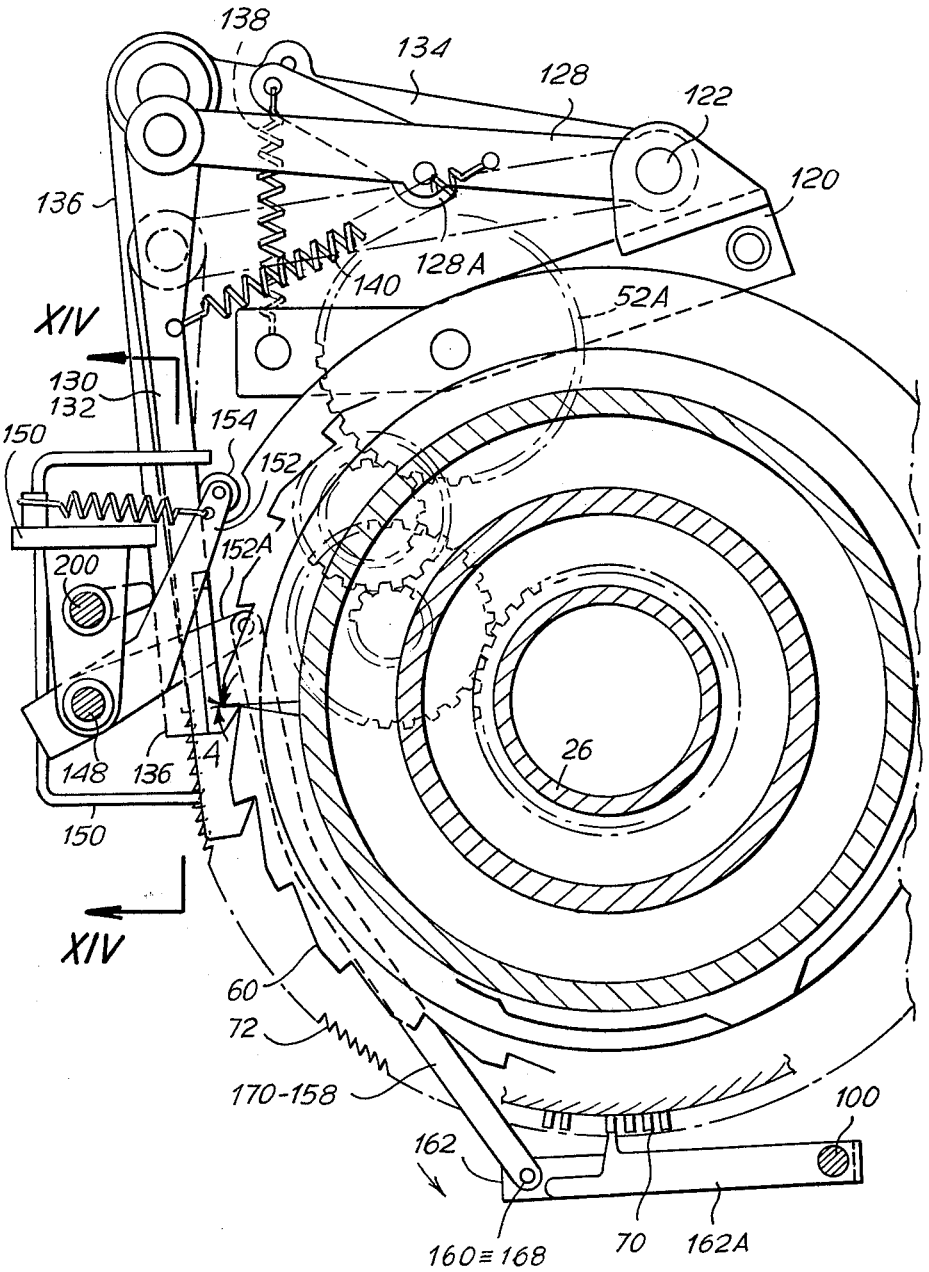
Figure 5:
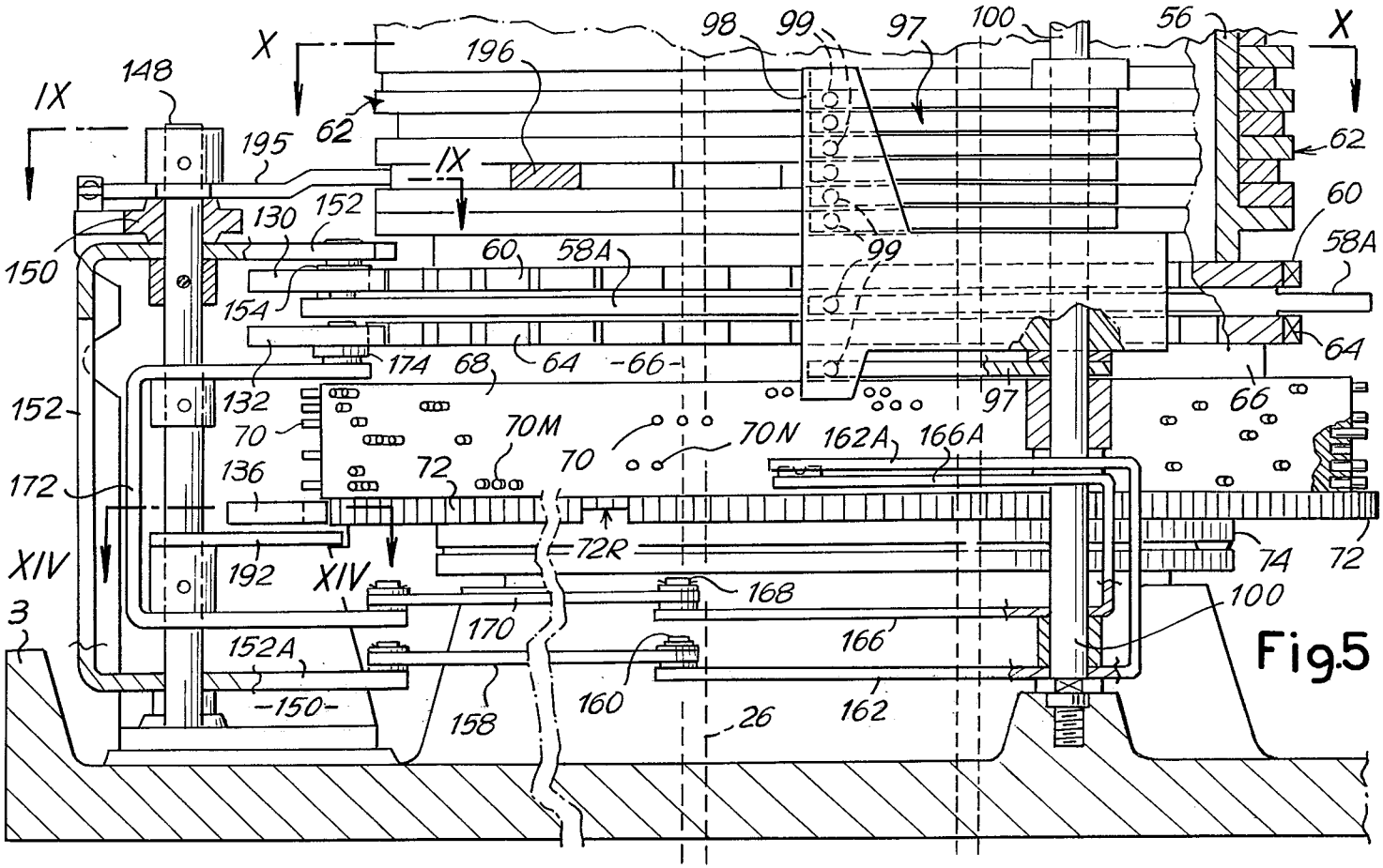
FIG. 5 is a section on the line V—V of FIG. 4.
Figure 6:
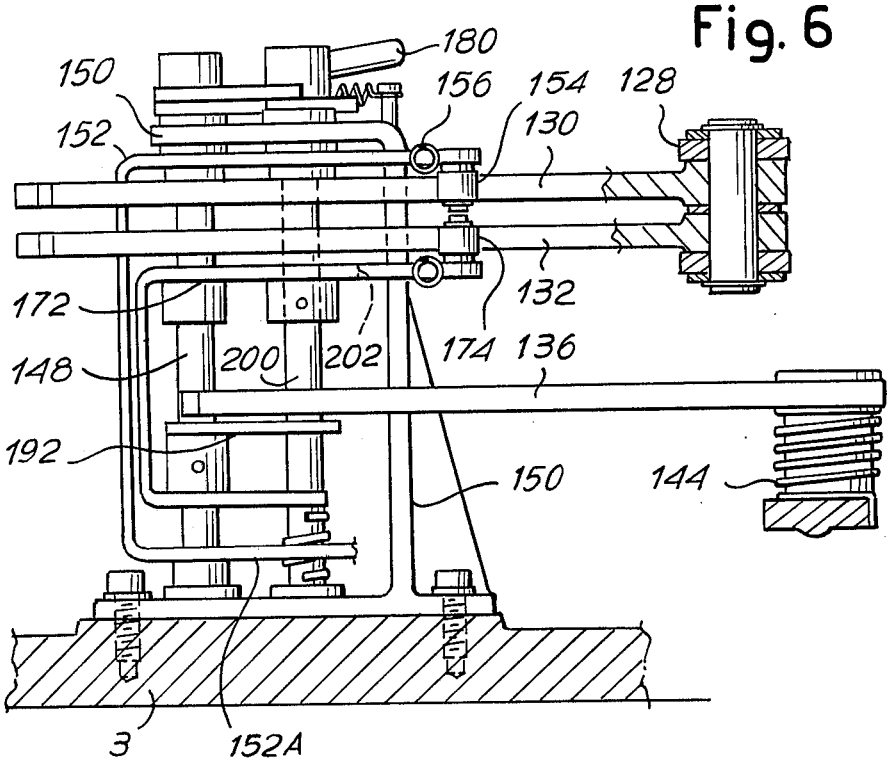
FIGS. 6, 7 and 8 are axial sections on the lines VI—VI, VII—VII and VIII—VIII of FIG. 4.
Figure 7:
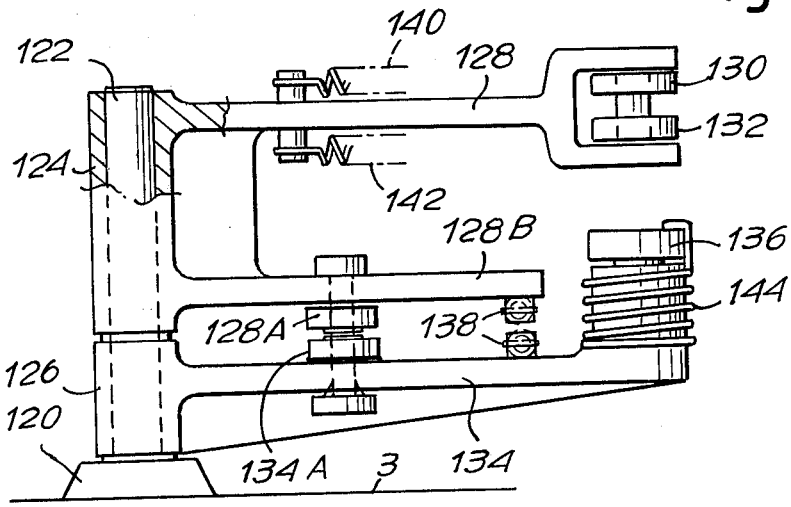

As shown in the accompanying drawings, a plate 3 is mounted on a base framework 1, and comprises a cylindrical seat 5 in which is inserted a body 7 to act as the frame for supporting the needle cylinder and all the other mechanisms of the invention. The body 7 is in the form of a body of revolution, and in particular (see FIG. 2) it comprises a series of external cylindrical surfaces 9, 10 and internal cylindrical surfaces 12, 13, together with transverse machined surfaces 14, 16 and 18. The surfaces 12 and 13 receive bearings 22 and 24 for a tubular member 26, the upper part of which carries the needle cylinder 28, which is provided with the usual longitudinal slots for the jacks with butts 30 and needles 32. The sinker ring 33 is rigid with the cylinder 28, and lies below the sinker cover 33A which carries the control cams for the sinkers. The cylinder 28 is slidably but not rotatably coupled to the tubular member 26 by means of a key 34. At the lower end of the cylinder 28 there is provided a flange 36 with an underlying thrust bearing 37, for controlling the vertical movements of the needle cylinder in order to vary the stitch, and consequently for contracting and lengthening the stitches in the conventional manner by means of a suitable control system described hereinafter. The needle cylinder is rotated by the tubular member 26, which is controlled by a belt transmission of which the pulley, rigid with the lower end of the member 26, is indicated by 38. A manual control system for rotating the cylinder is provided by way of a radial shaft 42 and a bevel gear coupling between said shaft 42 and the member 26. Ring gears such as 46, 48 and 76 are rigid with the tubular member 26. The ring gear 48 drives a reduction gear unit 50 which rotates—with a ratio of 4:1 or similar—a cam system 52 for intermittently advancing a program drum and a cam drum, which are coaxial with the tubular member 26 and consequently with the needle cylinder 28.

The ring gear 76 drives the welt dial and yarn cutting knife, and also—when necessary—drives by way of two gears 94, two devices 92, which control jack selection levers of the jack butts 30. The ring gear 46 drives the gear for any required anti-twist.

The body member 7 forming the frame comprises at its top a plate 7A, the surfaces 16 and 18 of which are machined, as stated. The member 7 is held in the seat 5 of the plate 3, and is locked therein by means of a set of bolts 54 after mounting a plurality of members constituting the program drum and cam drum. These comprise a cylindrical skirt 56 for forming the cam drum, which is directly mounted on the surface 10 to abut against the underneath of the flange 7A, and indirectly on the surface 9 by way of a centering and support element 58 comprising a flange 58A.

A ring gear 60 with relatively long ratchet teeth is also engaged between the member 58, 58A and the skirt 56 to form the toothed wheel for driving the cam drum, of which the skirt 56 forms part. On the skirt 56 there is provided a set of cam tracks, each of which, and in particular those indicated by 62, are cam tracks for controlling the stitch adjustment, one for each of the phases in which this adjustment is provided, and thus for controlling the vertical movements of the needle cylinder 28. Below the flange 58A there is mounted a second ring gear 64 with relatively long ratchet teeth, to constitute a rapid advancement ring gear for the return of a program drum 68. The two ring gears 60 and 64 can for example each comprise 24 teeth. Below the ring gear 64 there is disposed a cam track 66 which can be designed for gradually contracting the stitch at the ankle of a ladies stocking. Further below the ring gear 64 there is mounted the program drum 68 in which circumferential rows of bores are provided for the selective insertion of pins or rollers 70 intended to replace the controls normally operated by a chain programmer in conventional stocking machines. The drum 68 is also controlled by a ring gear 72 provided with a plurality of ratchet teeth which are smaller than those of the ring gears 60 and 64, and for example provided with two hundred and eightyeight teeth, corresponding to the radial bore seats for the pins or rollers 70. The bore tracks for the pins or rollers can for example be seven or more in number, for controlling, in the order stated, the return system, the cam drum, the speed, and other control requirements which can be necessary for particular machine operations. Pawls described hereinafter cooperate with the ring gears 60, 64 and 72. The cam drum 56 and program drum 68 move stepwise intermittently independently of each other, the program drum 68 being retained by a ring 74 below the member 58, 58A. The ring 74 on the surface 9 is provided with screws for fixing to the piece 7, said screws being mostly radial.

Between the flange 58A of the member 58 (mounted on and fixed to the surface 9 of the frame 7) and the terminal flange 7A of the frame 7, there are mounted spindles such as 82 and 84, having their axes parallel to the axis of the needle cylinder 28 and member 26, which support followers for the cams of the cam drum 56, for operating the selection and control members for the needles and thread guides in a skirt for cams or for other equivalent members, which is disposed above the flange 7A, on the surface 18 alone in the case of a simpler embodiment, whereas in the case of a more complicated embodiment a second platform 86 is also provided surrounding the needle cylinder, as in the case of the flange 7A, and carrying further control members combined with the needle cylinder. A further annular structure 88 is held on the columns 90 which support the platform 86, or on independent columns, for further members cooperating with the needle cylinder, such as the supports for the yarn guides and the like, all as in a conventional arrangement.

Other rods 80 raised by axial cams 78 on the drum 56 provide control actions on the cams of the hooks or the stitch or for other uses. The reference numeral 92 indicates overall one of the devices for controlling the levers which act on the jacks or jack butts, such as those indicated by 30 for selecting the needles for knitting, in a completely conventional manner, the rotational movement being taken from the member 26 by way of a transmission 94 from the ring gear 76 held between the surface 14 and surface 16, as in the case of the shaft 42 and transmission 44 already described. The space between the surfaces 14 and 16 also holds the system for controlling the vertical movements of the cylinder 28 by way of the flange 36, for contracting and lengthening the stitches.

Figure 10:
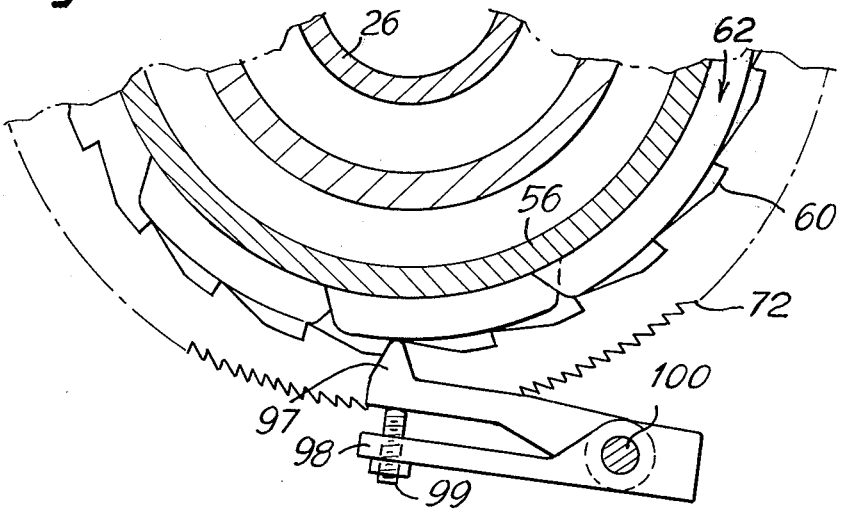

The adjustment of the stitches and the contraction, and consequently the axial movements of the needle cylinder 28, are controlled by providing cam tracks 62 on the cam drum 56 and the track 66 on the program drum 68, this latter for gradually contracting the stitch in the ankle. All of these tracks control, by way of respective adjustment screws 99, a single follower lever 98 which is rigid with a spindle 100 (FIG. 10) similar to the spindles 82, 84 and mounted on the flange 7A and on the plate 3. The tracks 62 and 66 can advantageously act on levers 97 (FIG. 10) which are freely hinged to the spindle 100, said levers 97 resting on the respective adjustment screws 99 carried by the lever 98 rigid with the spindle 100, to facilitate modification and adjustment of the control actions.

Figure 11:
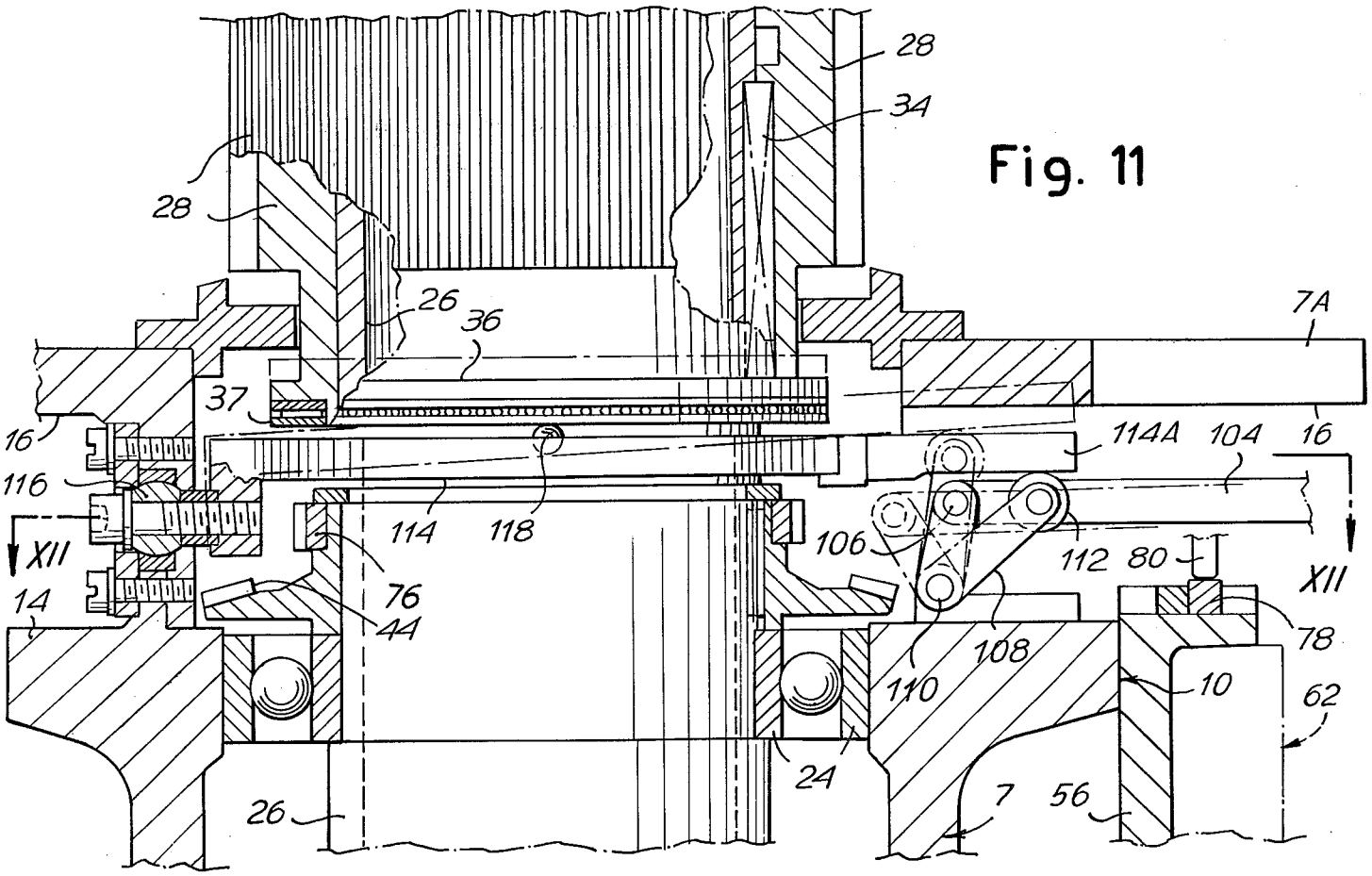
FIGS. 11 and 12 are a local diametrical section on the line XI—XI of FIG. 12 and a section on the line XII—XII of FIG. 11.
Figure 12:
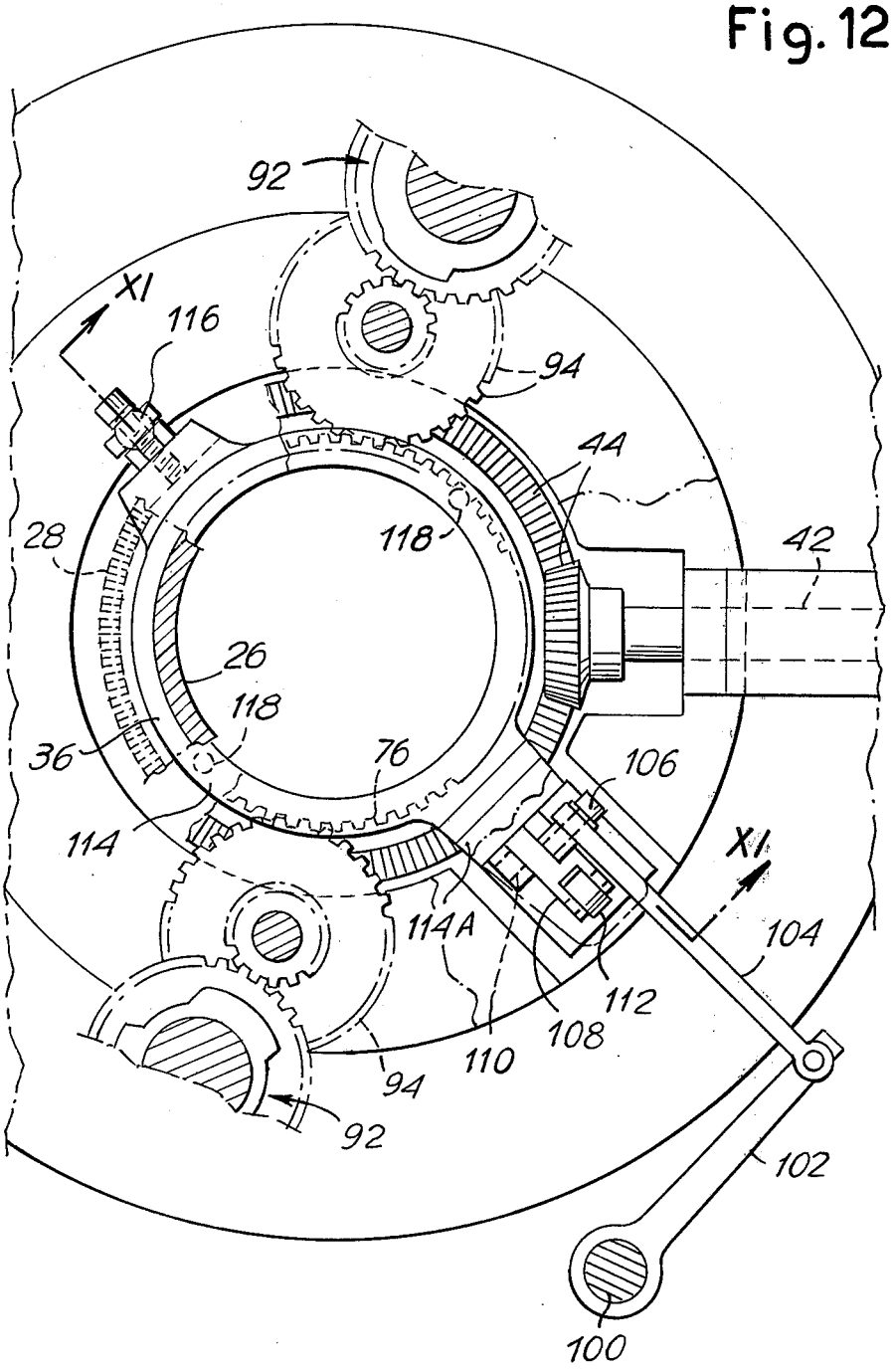

An arm 102 (FIGS. 11 and 12) is rigid with the upper end of the spindle 100, and controls a rod 104 which extends radially towards the axis of the needle cylinder and into the space between the surfaces 14 and 16. The rod 104 is hinged at 106 to a bracket 108 which is itself hinged at 110 to a support on the surface 14. The bracket 108 carries at its active end a roller 112 by means of which it acts on the lower surface of an appendix 114A of an annular fork lever 114 which embraces the tubular member 26 and is hinged by a ball joint at 116 at the opposite end to that of the appendix 114A. On a diameter perpendicular to the diameter joining the appendix 114A and the joint 116, the annular lever 114 carries a pair of thrust balls 118, on which the flange 36 of the cylinder 28 rests by way of the thrust bearing 37. When the spindle 100 makes an angular movement under the control of any one of the control tracks 62, 66, the fork 108 (FIGS. 11 and 12) is compelled to make an angular movement, and thus the lever 114 moves about its pivot 116, so either positively forcing the needle cylinder 28 upwards or allowing it to fall, thus determining the variation in the stitch length in order to obtain said contraction and elongation. This system for controlling the axial movements of the cylinder is particularly simple and precise, without being costly.

The reference numeral 120 (FIGS. 4, 4A, 5, 7) indicates a support fitted on to the plate 3 for a spindle 122 parallel to the axis of the needle cylinder, and on which are mounted two sleeves 124 and 126 for two control levers for the ratchet gears. A first lever 128 rigid with the sleeve 124 comprises forked ends for hinging two pawls 130 and 132 arranged to operate respectively on the ring gears 60 and 64 simultaneously, i.e. synchronously, but being made selectively operative in the manner indicated hereinafter. A second lever 134 rigid with the sleeve 126 is hinged at its end to a third pawl 136 arranged to act on the ring gear 72 comprising the smaller teeth. The lever 128 rests on the cam 52 by way of a thrust block 128A carried on a second arm 128B rigid with the sleeve 124, and the lever 134 rests on the cam 52A by way of a thrust block 134A. Suitable springs 138 act in such a manner as to ensure that the thrust blocks 128A and 134A rest resiliently on the cam 52 and 52A independently. By means of springs 140 and 142 coupled to the lever 128, the pawls 130 and 132 are urged to rest resiliently on the respective ratchet toothed ring gears 60 and 64, and a spiral spring 144 urges the pawl 136 against the ring gear 72.

Figure 13:
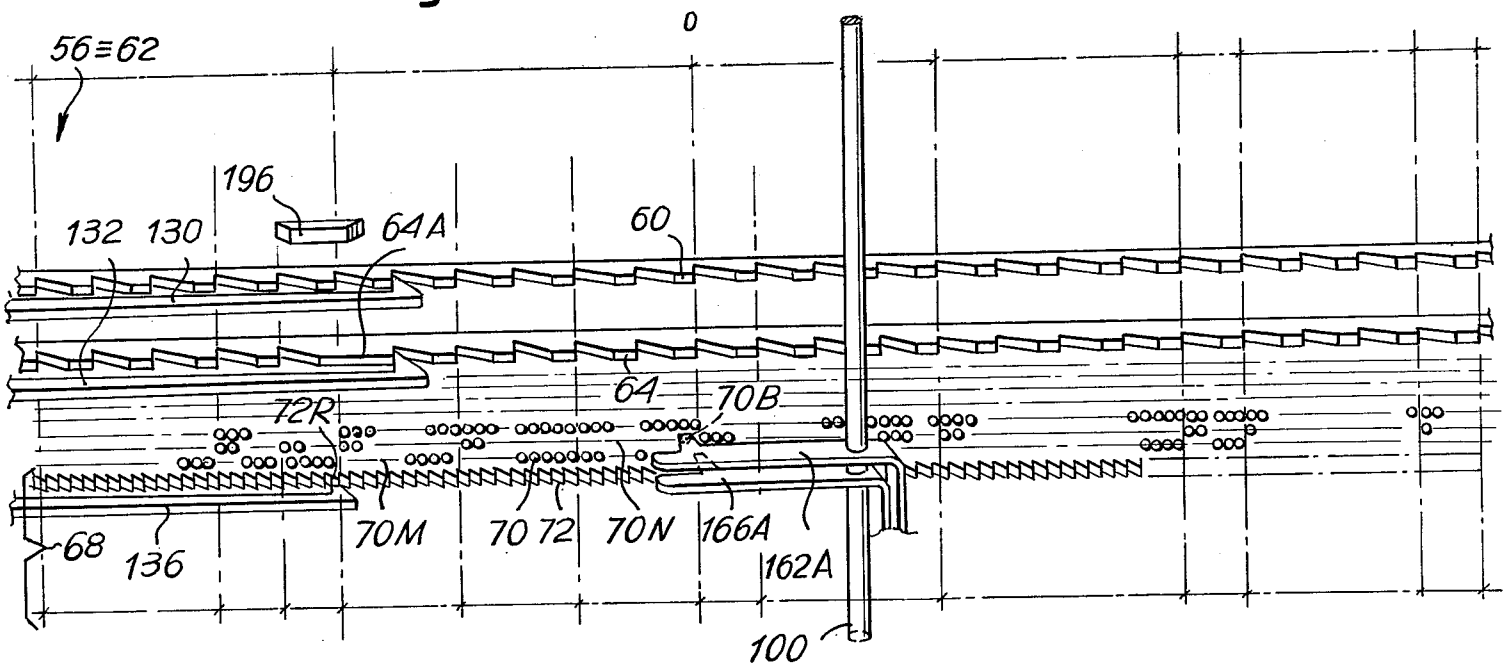
FIG. 13 is a diagrammatic developed view of the program and cam drums with their respective drive members.

Each of the pawls 130, 132 can be withdrawn independently of the other in order to interrupt its engagement with the respective ring gear while maintaining the reciprocating movement imposed on it by the continuously rotating cam 52. Interruption arms mounted on a spindle 148 are provided for withdrawing the pawls 130, 132. Said spindle 148 is mounted on a bracket support 150 which, by means of slots provided in it, also acts as guide means for the pawls 130, 132 and 136. An arm 152 acts by way of its thrust block 154 on the surface, i.e. on the edge, of the pawl 130 in order to withdraw it from the ring gear 60 by a movement which is imposed on the arm 152 by a spring 156 which is stronger than the spring 140. The arm 152 is of U shape, and its lower end 152A is hinged to a rod 158 which is hinged at 160 to a follower lever 162 of U shape hinged to the column or spindle 100. The upper arm 162A of the follower lever 162 is arranged to cooperate with a second track of pins 70 indicated by 70N (FIG. 13). The lower track of pins 70, indicated by 70M (FIG. 5), cooperates with a follower arm 166A of a second follower lever 166 which is also hinged to the column or spindle 100, and which by way of an articulated joint 168 and a rod 170 acts on a second U lever 172 similar to the lever 152 and mounted, as in this latter case, on the spindle 148 in order to control the pawl 132 by means of a thrust block 174. When one of the follower levers 162A or 166A encounters a pin 70N or 70M, it moves the respective rod 158 or 170, and thus causes a movement of the respective lever 152 or 172 against the action of the respective spring (such as the spring 156), so as to enable the springs 140 to act on the pawls 130 or 132 in such a manner as to lower them on to the respective ring gears 60 or 62. If a follower lever 162A or 166A does not encounter a pin 70 in the respective track 70N or 70M, then the force of the spring such as the spring 156, which acts on the respective lever 152 or 172, causes the respective pawl 130 or 132 to withdraw from the respective ring gear, so neutralising the force of the corresponding spring 140 acting on the pawl. Consequently the presence or absence of pins in the tracks 70M, 70N, determines the operation of the pawls 130 and 132. In practice, the pawl 136 is not controlled by a follower similar to that provided for the other pawls, but only by a manual system in order to halt the movement of the program drum when the machine is required to be rotated without moving any of the members controlled by the drums 62 and 63.

The pawl 136 is designed to determine a slow, intermittent cyclic advancement of the program drum 68 by acting on the ring gear 72 comprising short small teeth. When the followers 162A and 166A encounter a pin or roller, they activate the respective pawl 130 or 132 to determine a pulling movement only when the follower encounters a pin or roller 70. The pawl 136 gives a pulling movement equal to 1/12 of the pulling movement of the pawls 130 and 132, and is always engaged, to slowly rotate the program drum in order to present the successive rollers or pins 70 in front of the followers of the respective tracks.

When the follower 162A encounters a pin or roller 70 in the track 70N and rises over it, it activates the respective pawl 130, and this drives the cam drum 56 through one pawl pulling movement for each roller or pin 70 which presents itself under the follower 162A at any given time.

When the follower 166A encounters a pin 70M, it activates the respective pawl 132, which drives the program drum 68 with a rapid advancement which exceeds that determined by the pawl 136, so as to reduce the number of excess knitting rows between one operating phase and the next.

Leaving aside other functions imposed on the other tracks of the program drum 68, the programming, i.e. the presence and absence of pins or rollers 70 in the two tracks 70M and 70N, enables the program to be executed by the advancement of the cam drum 56 by means of the pawl 130, and the desired variation in the various phases to be determined, and thus a selective variation in the lengths of the various sections of the knitted article in order to modify the dimension of the article, i.e. to modify its so-called "size".

The ratchet toothed ring gears and the teeth of the pawls 130 and 132 are formed with an inclination (from the radial direction) of the coupling surfaces such that a pawl when engaged does not become withdrawn by the spring 156 which pulls it into the inactive position, even when the respective follower falls due to absent rollers 70 during the movement of the program drum. Consequently the engagement of a pawl 130 or 132 engaged with a tooth of the respective ring gear 60 or 64 is maintained until the pawl has completed its entire stroke and has imposed its entire pawl pushing movement on the respective ring gear. Engagement ceases as soon as the reverse movement of the pawl begins, i.e. the return movement of the pawl.

Figure 9:
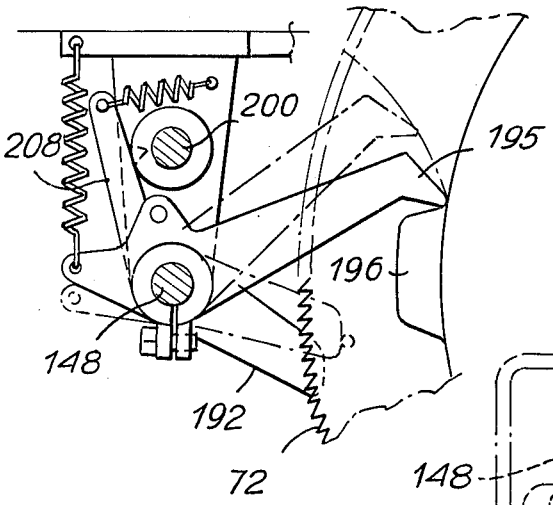
FIGS. 9 and 10 are local sections on the line IX—IX and X—X of FIG. 5.
Figure 8:
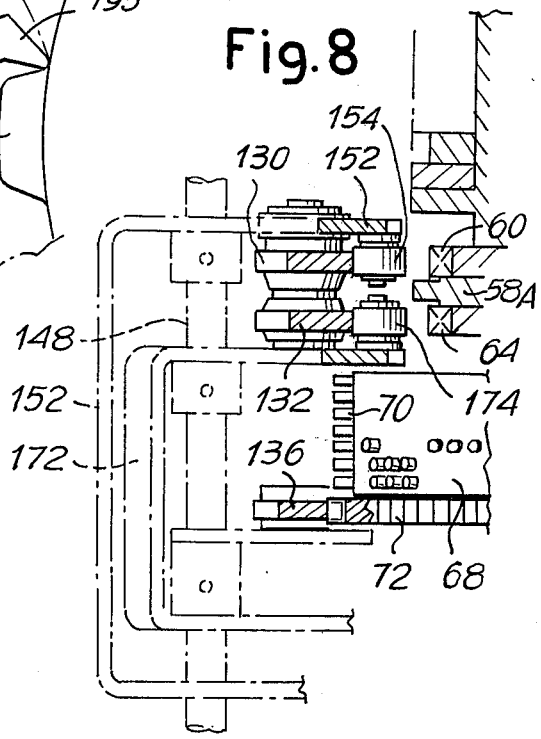

The machine is provided with means which ensure that at any moment there is the facility for rapid rephasing and rapid zeroing of the cam drum 56, and program drum 68, for example when for any reason the machine stops at an intermediate point of a working cycle. For this purpose a lever 180 can be made to act on the pawl 132 manually. This manual operation on the pawl 132 makes it active, and maintains it active either manually or by a device described hereinafter. This causes rapid advancement of the program drum 68, 70 in order to move it to a zero or cycle commencement position. This position is determined by the presence on the ring gear 64 of a covered tooth 64A (FIG. 13), i.e. comprising a flat portion which fills a space between two successive teeth. Consequently, in executing its cyclic movements, the pawl 132 can no longer act on the teeth of the ring gear 64, because this ring gear comprises the elongated tooth 64A, i.e. the filling of the space between two adjacent teeth, and the drum 68 thus stops in a "zero" position. The cam drum 56 remains at rest during this operation. Once the program drum 68 has been moved into its zero position, the pawl 136 for controlling the slow movement of the program drum finds itself opposite a point on the ring gear 72 at which the end of a lever 186 projects across a tooth, the purpose of this lever being to fill a space between the teeth 72R (FIG. 14). This thus neutralizes control by the pawl 136 when the program drum 68 has reached its "zero" position. If this does not correspond with a respective "zero" position of the cam drum 56, for the reasons stated hereinafter, the pawl 136 does not engage with any tooth of the ring gear 72, and thus the program drum remains at rest. As can be seen in detail in FIGS. 14 and 15, the tooth cover plate 186 is pivoted at 184 to the ring gear 72 and comprises an appendix 188 which can project outwards to emerge at the level of the crest of the teeth 72R of the ring gear 72, for this purpose it being urged by a spring 190 under normal operating conditions. The appendix 188 of the plate 186 can be urged inwards relative to the ring gear 72 against the action of the spring 190 by the movement of a lever 192 in the direction of the arrow f192, said lever 192 acting on a pin 186A of said tooth cover plate 186. The lever 192 is hinged to the spindle 148 which is controlled in order to operate the lever 192 (FIG. 9) by a follower 195 operated by a cam 196, which is located at the index line of the drum 56 coinciding with the origin of the program for the cams on said drum, i.e. at the "zero" point. If the program drum 68 and drum 56 are not out of phase, then at the end of an operating cycle when the covered teeth 72R (at the appendix 188) of the program drum 68 reach the pawl 136, the cam 196 acts on the follower 195 of the spindle 148, to move the lever 192 in the direction of the arrow f192 and urge the tooth cover plate 186 inwards, so that the appendix 188 withdraws and leaves the partial teeth 72R uncovered at the space from which said appendix 188 can withdraw. Consequently, the action of the pawl 136 on the ring gear 72 does not stop, and a new operating cycle begins in a regular manner without any discontinuity relative to the previous cycle. In contrast, if—for reasons of manual intervention, a fault or any irregularity—the drum 56 is out of phase with the drum 68, the cam 196 does not act when the space in the programmer drum 68, 70 corresponding to the appendix 188 comes in front of its pawl 136, and this latter is neutralised due to the fact that the tooth 72R of the ring gear 72 is covered by the appendix 188, which remains projecting. It should be noted that when the program drum 68, stops (due to the pawl 136 being neutralised by the appendix 188 and the filled tooth 64A as stated), the follower 162A for controlling the pawl 130 lies in a position corresponding with a pin or roller 70B of the track 70N, and thus the pawl 130 becomes activated to determine the rapid advancement of the cam drum 56 by acting on the ring gear 60 continuously at high speed until the index line, i.e. the "zero" line of the cam drum 56 is in phase with the "zero" line of the program drum 68. At this point, the cam 196 acts on the follower 195 of the spindle 148, and the lever 192 thus pushes against the pin 186A to cause the appendix 188 to withdraw, thus leading to a new action of the pawl 136 (on the teeth 72R), which begins to drive the program drum 68 again, perfectly in phase with the cam drum 56, and to also return to operation the yarn guides which may have been previously raised manually by the lever 180 (FIG. 16).

The two drums are re-phased by means of the handle 180, which is moved manually when it is required to return the two drums to zero. The lever 180 (see in particular FIGS. 16 to 19) is mounted on a spindle 200 parallel to the spindle 148, with which there is also rigid a lever 202 arranged to act on the lever 152 to withdraw the roller 154 from the pawl 132, against the action of a spring 204. With the assembly 180, 200, 202 there is rigid a cam 206 which, by way of its cavity 207, cooperates with a retention trigger 208. A pin 195A carried by the follower 195 can act on said trigger.

On moving the lever 180 manually from position A to position B, the cam 206 cooperates with the trigger 208, and simultaneously the thread guides are raised so that they are put out of operation. The cam 206 is retained against the action of the spring 204. The lever 152 and thus the roller 154 are moved by the spindle 200 and lever 202, to release the pawl 132. This approaches the ring gear 64, and drives it until it encounters the filled tooth 64A, at which the program drum stops at its "zero". The pawl 136 can also exert no further driving action because it encounters the tooth 72R covered by the appendix 188. Under these conditions the pin or roller 70B is located below the follower 162A to activate the pawl 130 until the cam of the cam 196 of the drum 56 is brought under the follower 195. The follower 195 then moves with the pin 195A until the trigger 208 is released, to free its tooth from the cavity 207 in the cam 206, which is released to return the spindle 200 and lever 180 into their normal position A, by virtue of the spring 204, in this position the lever 202 no longer influencing the lever 152, which thus withdraws the pawl 132 out of operation by way of the roller 154, until the pawl 132 is again left free to make its pushing movement by the pins 70M of the program drum, which act in the already stated manner on the lever 152. In this manner, the two drums automatically start again in phase with each other. When the spindle 200 is returned to position A by the spring 204, it can conveniently return the thread guides to operation.

It is therefore possible to obtain automatic rapid re-phasing after any stoppage or any out-of-phase situation which can arise between the program drum and cam drum, with automatic return of the yarn guides to operation.

The machine can also be equipped for operating with reciprocating motion. In this case, a gear box drives the unit 38 with reciprocating motion, the transmission 48, 50 being eliminated, while the cam system 52, 52A is still driven with continuous motion.

In the machine described the operating program and cycle can be easily and widely varied, and reliable and automatic re-phasing of the program drum and cam drum can be effected. The machine is of simple and economical construction.

What is claimed is:

1. In a circular knitting machine, a needle cylinder with needles and jack butts carried by the needle cylinder, yarn guides, a plurality of control members for the needles and jack butts, a cam drum coaxial with the needle cylinder, a ratchet system, including a pawl, for driving the cam drum, programming means which can be advanced in relation to the rotation of the needle cylinder, said programming means comprising a program drum coaxial with the needle cylinder and the cam drum being independent thereof, said drum having programming members which can be changed, a drive system synchronised with the motion of the needle cylinder for advancing slowly the program drum, a ratchet system which determines the length of the programs and the re-phasing, and is operative to effect rapid advancement of the program drum, said system being able to be combined with the ratchet drive system of the cam drum, follower means arranged to activate and deactivate said ratchet systems, a manual control arranged to activate the rapid advancement re-phasing ratchet system for the program drum until this latter reaches a zero position at which the rapid advancement of said program drum ceases, a member disposed in the zero position of the program drum to activate the cam drum pawl until the cam drum is also moved into the zero position, and a cam in the zero position on the cam drum to control the initial slow advancement of the program drum when both the drums reach an in-phase zero position.

2. A circular knitting machine according to claim 1, further comprising a slow advancement ring gear associated with the program drum and having teeth, a slow moement pawl co-operating with the ring gear, a movable profile for covering at least one of said teeth at a stop and zero point, said profile being arranged to project from the teeth in order to neutralise the slow movement pawl, a lever carrying said profile, and linkage for moving the lever, said linkage being actuated to remove said profile by the said cam in the zero position on the cam drum.

3. A circular knitting machine according to claim 1, comprising a cam on the program drum for contracting the stitch in an ankle portion of a stocking being knitted, further contracting cams on the cam drum, a single follower lever for moving the needle cylinder axially, individual followers for moving said following lever, and screws for individually adjusting the followers.

* * * * *